US010371411B2

(12) United States Patent
Cursetjee et al.

(10) Patent No.: US 10,371,411 B2
(45) Date of Patent: Aug. 6, 2019

(54) CEILING SYSTEM WITH INTEGRATED EQUIPMENT SUPPORT STRUCTURE

(75) Inventors: Zareer Cursetjee, Clackamas, OR (US); Kevin Schreiber, Happy Valley, OR (US); David L. Baugh, Newberg, OR (US)

(73) Assignee: Nortek Air Solutions, LLC, O'Fallon, MO (US)

( * ) Notice: Subject to any disclaimer, the term of this patent is extended or adjusted under 35 U.S.C. 154(b) by 1046 days.

(21) Appl. No.: 12/589,475

(22) Filed: Oct. 22, 2009

(65) Prior Publication Data

US 2011/0097986 A1 Apr. 28, 2011

(51) Int. Cl.
*F24F 13/32* (2006.01)
*E04B 9/00* (2006.01)
*E04B 9/04* (2006.01)

(52) U.S. Cl.
CPC ..... *F24F 13/32* (2013.01); *E04B 9/006* (2013.01); *E04B 9/0478* (2013.01); *F24F 2221/14* (2013.01)

(58) Field of Classification Search
CPC ..... H05K 7/20; F24F 13/32
USPC ..... 454/187, 185, 186
See application file for complete search history.

(56) References Cited

U.S. PATENT DOCUMENTS 2,569,910 A * 10/1951 Venuti ..... F24D 5/02 285/125.1
3,252,400 A * 5/1966 Madl, Jr. ..... F24F 3/161 454/187
4,510,851 A * 4/1985 Sarnosky et al. ..... 454/346
4,645,158 A * 2/1987 Manning ..... F24F 13/32 248/343
5,488,809 A * 2/1996 Lindsay ..... 52/653.1
5,885,154 A * 3/1999 Napadow et al. ..... 454/301
5,971,572 A 10/1999 Rouchon et al.
6,034,873 A * 3/2000 Ståhl et al. ..... 361/701
(Continued)

FOREIGN PATENT DOCUMENTS

CA 2776558 C 9/2018
CN 102667023 A 9/2012
(Continued)

OTHER PUBLICATIONS

International Search Report and Written Opinion; dated May 18, 2011; PCT/US2010/046463; 8 pages.
(Continued)

*Primary Examiner* — Steven B McAllister
*Assistant Examiner* — Samantha A Probst
(74) *Attorney, Agent, or Firm* — Schwegman Lundberg & Woessner, P.A.

(57) ABSTRACT

A modular air-handling plenum for capable of supporting surgical apparatus or other objects is disclosed. The plenum is usually rectangular, may be formed of sheet metal, and features a truss spanning the width of the plenum to carry the weight of the apparatus. The plenum itself is attached to the ceiling of a room. An air handling component may be included to provide filtered and/or conditioned air in the vicinity of the suspended apparatus, or the plenum may be used strictly as an apparatus support, with no air-conditioning function. An ordinary suspended ceiling may also be mounted in the plenum for continuity with the remainder of the room.

21 Claims, 5 Drawing Sheets

(56) References Cited

U.S. PATENT DOCUMENTS

| | | | | |
|---|---|---|---|---|
| 6,132,309 | A * | 10/2000 | Panelli et al. | 454/187 |
| 6,514,137 | B1 * | 2/2003 | Panelli et al. | 454/187 |
| 6,870,092 | B2 * | 3/2005 | Lambert et al. | 174/355 |
| 7,125,332 | B2 * | 10/2006 | Beaver et al. | 454/369 |
| 7,224,472 | B2 | 5/2007 | Bauch et al. | |
| 7,921,489 | B2 * | 4/2011 | Newkirk | A61M 5/1415 137/355.16 |
| 7,937,903 | B2 * | 5/2011 | McGee | E04B 9/02 248/317 |
| 7,944,692 | B2 * | 5/2011 | Grantham et al. | 361/688 |
| 8,434,526 | B1 * | 5/2013 | Pinkalla | F24F 13/02 138/106 |
| 2002/0078645 | A1 * | 6/2002 | Meyer | 52/289 |
| 2005/0258722 | A1 * | 11/2005 | Sullivan | 312/245 |
| 2007/0254583 | A1 * | 11/2007 | Germagian et al. | 454/184 |
| 2008/0120924 | A1 * | 5/2008 | Mintie | B08B 15/00 52/63 |
| 2009/0151910 | A1 * | 6/2009 | Kwon et al. | 165/121 |
| 2009/0191809 | A1 * | 7/2009 | Smith | 454/354 |
| 2009/0239461 | A1 * | 9/2009 | Lewis et al. | 454/184 |
| 2010/0015909 | A1 * | 1/2010 | Bacharach | 454/365 |
| 2010/0093268 | A1 * | 4/2010 | McCall et al. | 454/119 |
| 2010/0190430 | A1 * | 7/2010 | Rodriguez et al. | 454/184 |
| 2010/0248609 | A1 * | 9/2010 | Tresh et al. | 454/184 |
| 2010/0248610 | A1 * | 9/2010 | Caveney et al. | 454/184 |
| 2011/0009047 | A1 * | 1/2011 | Noteboom et al. | 454/184 |
| 2011/0141741 | A1 * | 6/2011 | Engstrom | F21V 21/03 362/257 |
| 2011/0214945 | A1 * | 9/2011 | Jolicoeur | E01D 19/106 182/150 |
| 2011/0287704 | A1 * | 11/2011 | Lewis et al. | 454/184 |
| 2011/0300788 | A1 * | 12/2011 | Caveney | 454/184 |
| 2012/0272615 | A1 * | 11/2012 | Evans | H02G 3/125 52/745.21 |
| 2015/0069664 | A1 * | 3/2015 | Ciuperca | B28B 7/0032 264/333 |

FOREIGN PATENT DOCUMENTS

| | | | |
|---|---|---|---|
| DE | 4317923 | A1 | 12/1994 |
| DE | 202005020919 | U1 | 12/2006 |
| EP | 0 785 332 | | 7/1997 |
| EP | 1 340 470 | | 9/2003 |
| EP | 2491196 | A2 | 8/2012 |
| EP | 2491196 | B1 | 5/2016 |
| KR | 10-0903018 | | 6/2009 |
| WO | WO-9427549 | A1 | 12/1994 |
| WO | WO-2011/049670 | A1 | 4/2011 |

OTHER PUBLICATIONS

"Chinese Application Serial No. 201080047533.5, Office Action dated Dec. 4, 2013", (w/ English Summary), 6 pgs.
"Chinese Application Serial No. 201080047533.5, Voluntary Amendment filed Jan. 24, 2013", (w/ English Translation of Claims), 8 pgs.
"European Application Serial No. 10825363.4, Office Action dated Jun. 19, 2012", 2 pgs.
"Indian Application Serial No. 3197/DELNP/2012, Request for Examination filed Sep. 19, 2013", 3 pgs.
"International Application Serial No. PCT/US2010/046463, International Preliminary Report on Patentability dated May 3, 2012", 5 pgs.
"Malaysian Application Serial No. PI2012001509, Preliminary Examination dated Jun. 27, 2012", 2 pgs.
"Philippines Application Serial No. 1/2012/500764, Substantive Examination Report dated Aug. 17, 2013", 1 pg.
"Singapore Application Serial No. 201202759-5, Search and Examination Report dated Jul. 8, 2013", 10 pgs.
"Chinese Application Serial No. 201080047533.5, Response filed Apr. 16, 2014 to Office Action dated Dec. 4, 2013", (w/ English Translation of Claims), 8 pgs.
"European Application Serial No. 10825363.4, Amendment filed Jul. 7, 2014", 3 pgs.
"European Application Serial No. 10825363.4, Office Action dated Jul. 25, 2014", 2 pgs.
"Philippines Application Serial No. 1/2012/500764, Substantive Examination Report dated Aug. 5, 2014", 2 pgs.
"European Application Serial No. 10825363.4, Extended European Search Report dated Sep. 22, 2014", 6 pgs.
"Canadian Application Serial No. 2,776,558, Office Action dated Apr. 10, 2017", 4 pgs.
"Canadian Application Serial No. 2,776,558, Office Action dated May 9, 2016", 4 pgs.
"Canadian Application Serial No. 2,776,558, Response filed Oct. 10, 2017 to Office Action dated Apr. 10, 2017", 7 pgs.
"Canadian Application Serial No. 2,776,558, Response filed Nov. 8, 2016 to Office Action dated May 9, 2016", 18 pgs.
"European Application Serial No. 10825363.4 Response filed Apr. 17, 2015 to Communication Pursuant to Rule 70(2) EPC dated Oct. 10, 2014", 11 pgs.
"Machine Translation of DE 4317923, published Dec. 1, 1994", 10 pgs.
"Machine Translation of WO 94/27549A1, publshed on Dec. 8, 1994", 12 pgs.
"Mexican Application Serial No. MX/a/2012/004512, Office Action dated Jun. 22, 2016".
"Indian Application Serial No. 3197/DELNP/2012, First Examiner Report dated Nov. 22, 2018", English translation, 6 pgs.

* cited by examiner

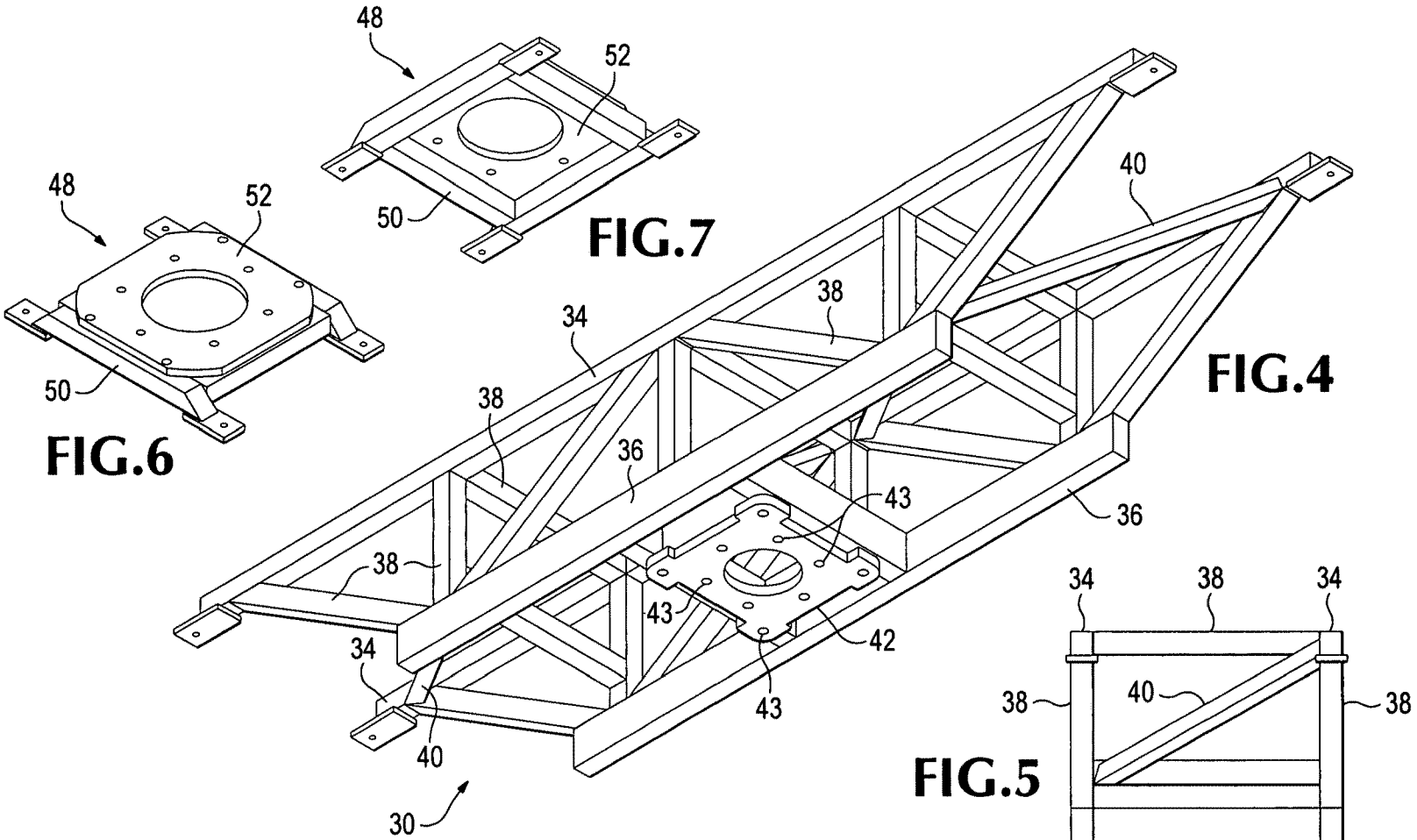
FIG.4
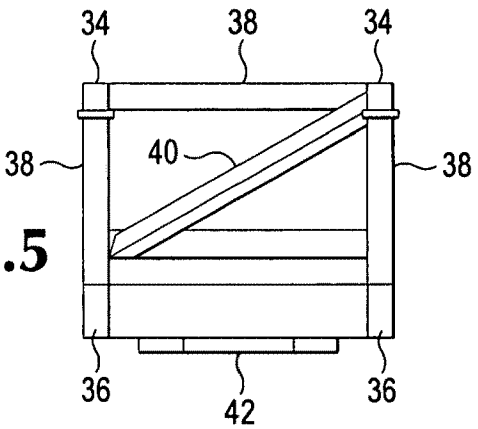
FIG.5
FIG.7
FIG.6

CEILING SYSTEM WITH INTEGRATED EQUIPMENT SUPPORT STRUCTURE

BACKGROUND

Certain interior environments, such as clean rooms and hospital like operating rooms, radiology rooms, and dental suites, require unusually clean air for the protection of the work that takes place in them. Such rooms may also have disparate heating or cooling needs at different points in the room. For instance, electronic equipment may produce excess heat, therefore requiring that cooled air be concentrated in its vicinity. Surgeons may also find it prudent to have available additional heated or cooled air in the immediate vicinity of an operating table, to hold a patient at a stable temperature or dissipate the excess heat created by bright lamps or a team of doctors and nurses surrounding the patient. However, the needs of a given room can change over time, as new technology replaces what was originally installed or the room is converted to uses or configurations other than the original. For these reasons, it is undesirable to have air conditioning and ventilation permanently installed as part of the structure of the building. Additionally, when multiple parties provide equipment for these spaces, there is significant coordination required during the design and construction phase to avoid conflicts and interferences in product and schedule. Instead, modular systems which may be installed or removed with only minor structural alterations are desirable.

Modular installation has the additional advantage of making construction less expensive and more convenient. Ventilation structures need not be custom fabricated on-site, nor incorporated into the structure during construction. Instead, modular units may be mass-produced at a factory off-site and shipped to the building when it is ready to receive them. On-site fabrication is then limited to such fabrication and alterations as are necessary to attach the modular units to the building's frame.

In modern operating rooms equipment such as robotic surgical aids are becoming more and more prevalent. These devices make surgery more precise and less prone to errors caused by the inherent fallibility of human hands. Additionally, even in more conventional clean environments, there is a significant requirement for overhead-supported equipment such as light and equipment booms, automated material handling systems, etc. Typically, such equipment is hung from the building structure and descends through the ceiling in order to preserve valuable floor space. However, this arrangement is subject to the similar problems as hard-wired ventilation: it is expensive, requires a custom installation during building construction, and may limit the possible room configurations based on the nature of the underlying building frame.

SUMMARY OF THE INVENTION

The present invention solves the problems of the prior art and permits the convenient, cost-effective, and easily alterable installation of surgical aids, or any other form of apparatus, from the ceiling of a room, including an operating or clean room. This is accomplished by providing a truss connected to a modular ventilation plenum, the truss being capable of supporting the apparatus to be hung. The truss's position within the plenum may be selected to allow some flexibility relative to the building's underlying frame, and the plenum itself, being of a modular design, may be mounted in a variety of locations. Both truss and plenum may be assembled off-site, installed after the majority of building construction is complete, and repositioned much more easily than systems tied directly to the underlying structure. In addition, the present invention allows the convenient co-location of two items both required directly over the operating area, with neither interfering with the other: ventilation and equipment support. It also allows installation of a modular equipment support without ventilation, if preferred.

The present design also includes a suspended grid system of the type commonly found in commercial ceilings within the plenum itself, to preserve the continuity of the ceiling in the room. This grid is designed to accommodate a smaller equipment support attached to a suspended grid system, allowing the placement of smaller and lighter surgical apparatus, illumination, or similar necessities.

BRIEF DESCRIPTION OF THE SEVERAL DRAWINGS

FIG. 4 is a perspective view of the truss in isolation.

FIG. 5 is an elevation view of the truss from one end.

FIG. 6 is a perspective view of the top of the equipment support, as it would appear from above the suspended grid.

FIG. 7 is a perspective view of the bottom of the equipment support, as it would appear from below the suspended grid.

DETAILED DESCRIPTION OF PREFERRED EMBODIMENTS

Figure 1:
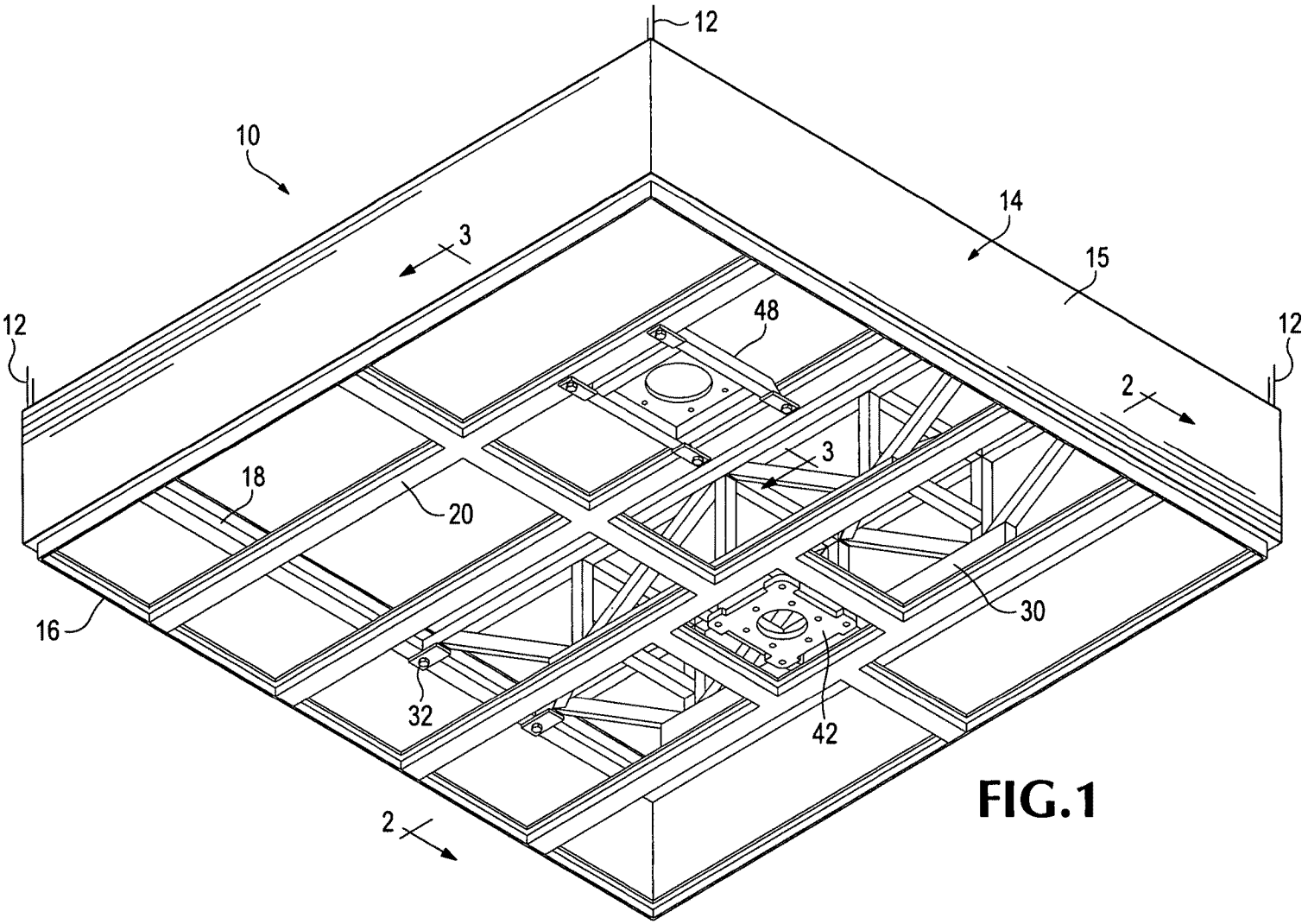
FIG. 1 is a perspective of the plenum from below, as it would appear when installed, including the truss, suspended grid, and grid-based equipment support.

Turning now to FIG. 1, a modular unit embodying the present invention is depicted. A plenum 10 may be suspended from hangars 12, which are in turn attached directly to the I-beams or other frame of the building. The hangars 12 may also be attached to a secondary structure (not shown) which in turn attaches to the building's frame. This arrangement permits the placement of plenum 10 in locations other than directly below the building's structural beams. Alternatively, plenum 10 may also be bolted directly to part of the building or an adapter rather than suspended from hangars 12. Hangars 12 are shown at the corners of plenum 10, but may be placed in other locations, or with greater spatial frequency than is shown.

The plenum 10 is formed from a perimeter 14 of material, conventionally sheet steel although any sufficiently rigid material will do, using methods well known in the art. The plenum 10 is typically a rectangle or square, and is built in a size chosen to accommodate the heating and cooling needs of the building as well as to accommodate the structure to which it is to be attached. The perimeter 14 is given enhanced rigidity by the presence of lower lip 16 and upper rail 18. The upper rail 18 provides the primary structural member of the plenum 10. The rail is typically constructed of steel 0.188 inches thick, formed into a rectangular tube about 3"×4". The upper rail 18 is welded to sheet steel wall 15, and lower rail 16 is formed by bending wall 15. Grid members 20 may be attached to lower lip 16, forming a grid of supports for the ordinary parts of a suspended ceiling, such as ceiling tiles, lights, and vents for air passage (not shown). Alternatively, grid members may be attached to the sheet steel wall 15 directly. Grid members 20 are conventionally constructed as rectangular tubes or U-shaped channels of stainless steel, or extruded aluminum, but may be constructed of other materials and in other shapes as well. The grid members 20 are sufficiently rigid that that they span the plenum 10 without additional support, easing attachment of the plenum 10 to the building structure and installation of the grid members 20. Grid members 20 may also be attached to the building structure, for instance by the use of additional hangars 12, for greater load-bearing capacity.

Figure 8:
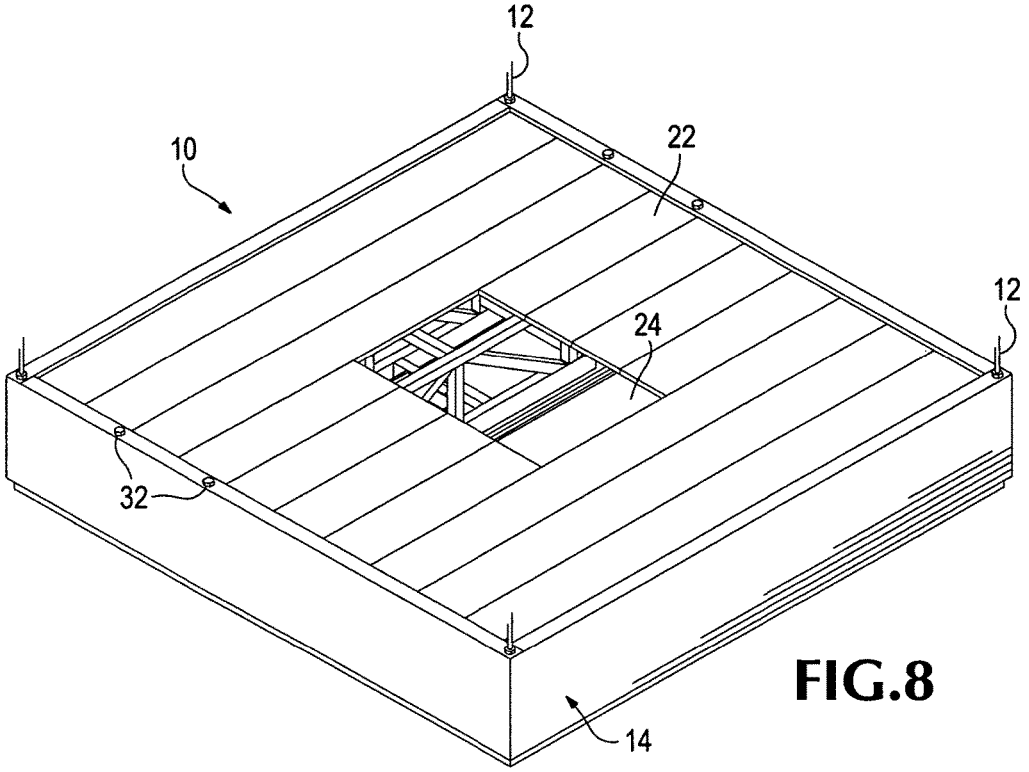
FIG. 8 is a perspective view of the top of the plenum, showing a hole in the center through which air may pass as part of a ventilation system.
Figure 9:
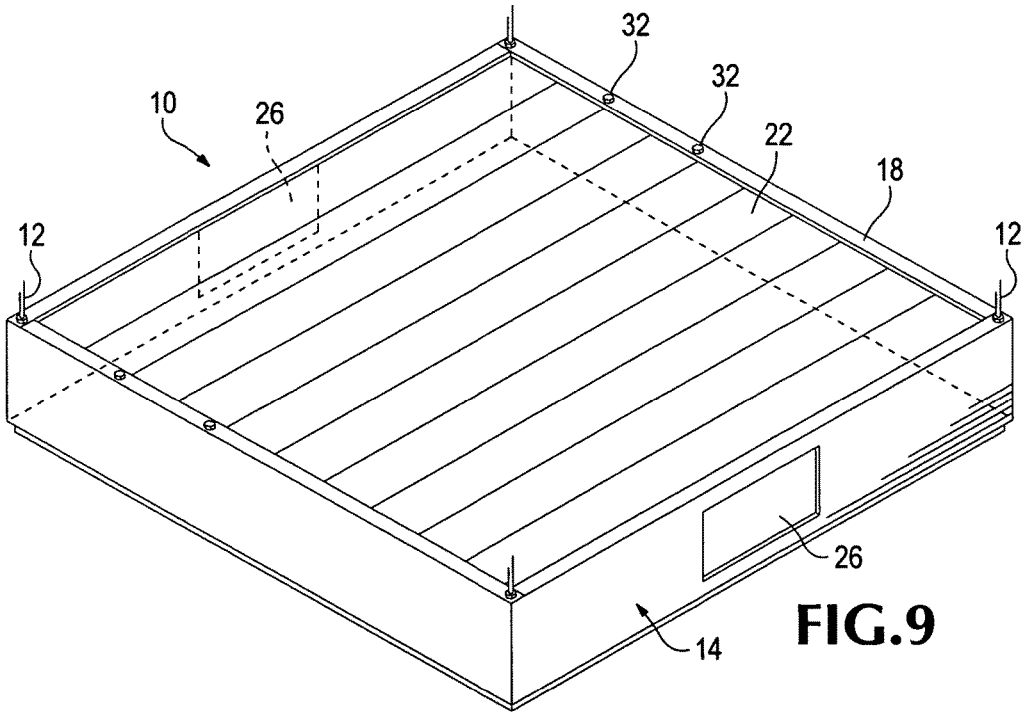
FIG. 9 is a perspective view of the top of the plenum, showing holes in two sides through which air may pass as part of a ventilation system.
Figure 10:
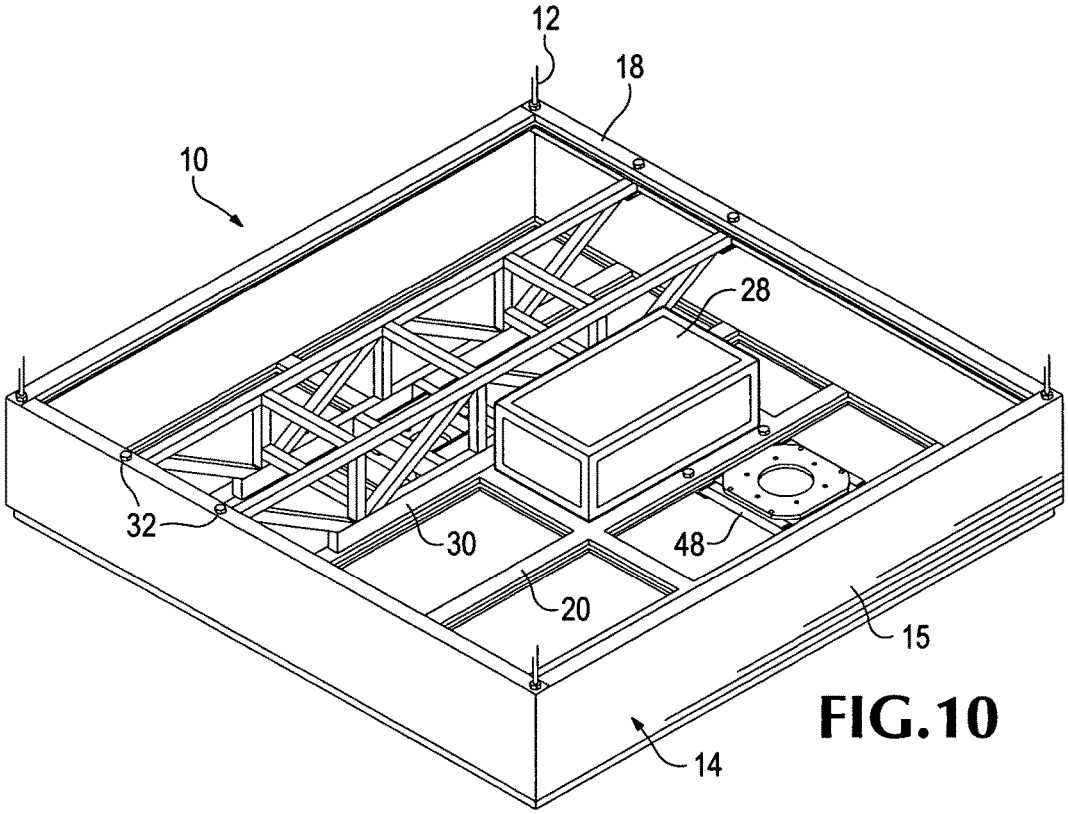
FIG. 10 is a perspective view of the top of the plenum, showing an air handling component, such as a fan/filter unit, mounted to the suspended grid system.

The plenum 10 may be sealed at the top to control airflow by plenum roof 22, best shown in FIGS. 8 and 9. This roof is usually sheet metal similar to that found in perimeter 14, but need not be. A hole 24 may appear in the plenum roof 22 to permit air to enter or leave the plenum 10, and therefore the room, or holes 26 may be found in perimeter 14 for the same purpose. An air handling component (not shown) may be mounted adjacent holes 24 or 26, or a duct (not show) may lead to them. Alternatively, the plenum may have an air handling component 28 mounted directly to the grid members 20, as best shown in FIG. 10, such that the plenum itself does not control airflow. The air handling component may comprise a fan, a filter, air conditioning coils, heating elements, humidifiers, dehumidifiers, or any combination of these or similar elements, all of which are well known in the art.

Figure 2:
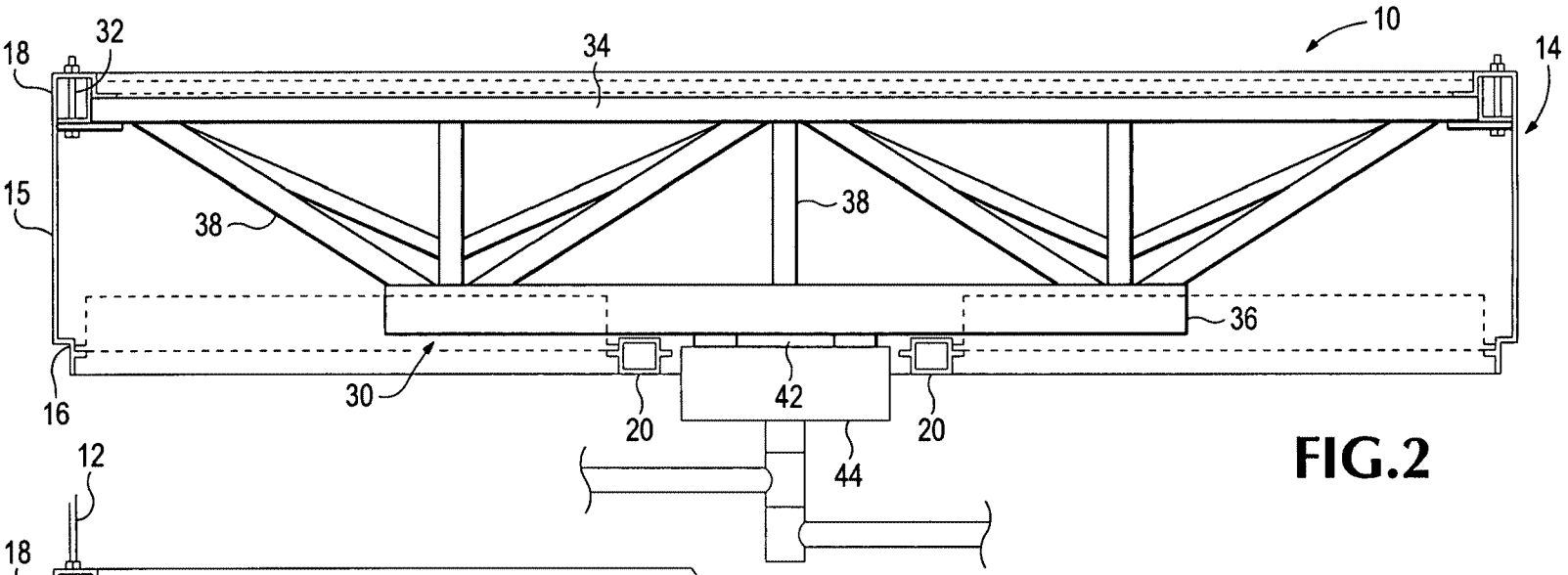
FIG. 2 is a section taken along line 2-2 of FIG. 1, showing the truss with an appended surgical device.
Figure 3:
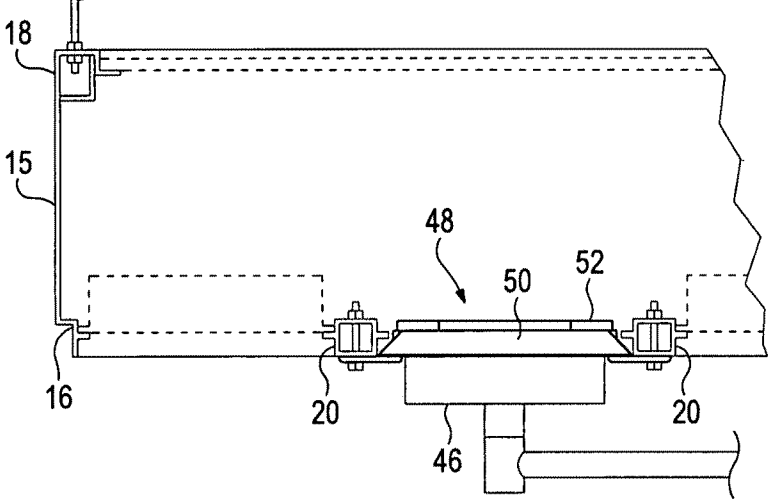
FIG. 3 is a section taken along line 3-3 of FIG. 1, showing the equipment support with an appended surgical device.

A truss 30, best shown in FIGS. 2 and 4, spans the plenum 10 and is firmly attached to the upper rail 18. In a rectangular plenum 10, the truss 30 preferably spans the shorter dimension, so as to maximize its weight-bearing capacity. In the figures, truss 30 is attached by bolts 32, which allows for easy installation and removal. Any other suitably rigid form of attachment, such as rivets or welding, may be used, although these may not be as convenient. The truss 30 is composed of upper spars 34, lower spars 36, and various cross members 38, which link the spars together and provide rigidity. Diagonal cross members 40 provide resistance to twisting. The truss 30 may be constructed of steel or aluminum that has been cast, extruded, forged, or otherwise formed into structural shapes, such as tubes, I-beams, or U-channels. The truss 30 may also be made of composite materials such as fiberglass or carbon fiber, formed sheet steel, or any other suitably sturdy material. The truss 30 may even employ several different types of material in its construction. The spars 34, 36 and cross members 38, 40 are preferably welded together if metal, and glued or molded as a single piece if composite, but they may also be joined by bolts, rivets, or other means known in the art. The precise choice of materials and design for the truss 30 will be determined by such factors as the required strength, the need to minimize weight, and the manufacturing cost. These considerations are well understood in the art. It will be understood that no particular configuration of spars and cross members, nor any particular material choice, is required to practice the spirit of the invention.

The truss 30 may also be installed as part of the perimeter 14 of a plenum, or even between two neighboring plenums 10, forming a part of the perimeter 14 of each. In this configuration, the truss 30 may be open to airflow. The truss 30 may also be closed to airflow, for instance by attachment of a sheet of metal across one or both sides of the truss 30.

The truss 30 may incorporate dedicated passageways for routing of electrical conduits or lines supplying such things as natural gas, refrigerant, water, gases such as oxygen or nitrogen, or vacuum.

An equipment interface plate 42 is mounted to the truss 30 between the lower spars, and provides a mounting location for heavy equipment 44, such as robotic surgical aids. This plate is most commonly metal, but may be any material of suitable strength. Preferably, the equipment interface plate 42 has a bolt-hole pattern 43 which matches that of heavy equipment 44 to permit convenient installation and removal without the need for adapters or jigs. The holes may be threaded or clearance holes. The equipment interface plate 42 may be welded to truss 30, or bolted for easier installation and removal. Other attachment methods, such as riveting, are also possible. It may be manufactured "blank," without any bolt-hole pattern 43, and then machined to match whatever heavy equipment 44 is ultimately selected.

The weight of the heavy equipment 44 is transferred by the truss 30 to the upper rail 18 (and to some degree, to the remainder of perimeter 14), and thence to the hangars 12 and into the building's structure. The truss 30 may be independent of the grid members 20, so that any movement in the truss 30 is not directly transferred to the grid members 20, and vice versa. This may be advantageous when, for instance, a light (not shown) attached to grid members 20 is manually adjusted; the movement of the light will have a minimal effect on the heavy equipment 44 suspended from the truss 30. When the truss 30 and grid members 20 are structurally independent, they may be loaded independently of each other, with reference only to the total load that the plenum 10 and hangars 12 can support. On the other hand, the truss 30 and grid members 20 may be linked together. This configuration provides maximum load-bearing capacity and maximum lateral stability for the heavy equipment 44 mounted on the truss 30.

The truss 30 shown in the drawings, when constructed out of welded tube steel and connected to the plenum 10, can support at least 900 lbs of heavy equipment 44 and can bear at least 8000 ft-lbs of torque about an axis running parallel to the spars 34, 36.

Lighter apparatus 46 may also be attached to the plenum 10 at the grid members 20, either on the top or bottom of these members, by the use of apparatus mount 48. The grid members are obviously not capable of supporting the same amount of weight as the truss 30 due to their flatter construction, and in addition, they must bear the weight of multiple other items, such as lighting. However, apparatus mount 48 is also more versatile than truss 30. It allows the positioning of lighter apparatus 46 in more places, including some not reachable by truss 30, and also permits the repositioning of lighter apparatus 46 much more conveniently. Similar to the operation of truss 30, apparatus mount 48 transfers the weight of lighter apparatus 46 to the grid members 20, which then transfer it to the lower rail 16, then through perimeter 14 and into hangars 12. When used unreinforced, the grid can bear around 300 lbs. in weight. This amount may be raised considerably by hanging a stud 12 from the building's structure and attaching it to the grid members 20 directly for additional support.

Apparatus mount 48 is comprised of frame 50 and support plate 52. As with the other components of the plenum 10, these advantages are best achieved if apparatus mount 48 is bolted to the grid members 20, but it may also be attached in other ways. Similar to equipment interface plate 42, the support plate 52 may be welded to frame 50, but it may also be bolted, riveted, or otherwise attached.

It is also possible for the plenum to be installed with no air-conditioning function at all, purely as a hanger for ceiling-mounted equipment. In that case, the truss 30 or apparatus mount 48 can be mounted within the plenum 10, but without any air-handling component 28, plenum roof 22, or holes 26. This system is modular, convenient, and inexpensive, and may be employed anywhere, whether in a clean room, operating room, or ordinary office or industrial environment that requires equipment to be hung from above.

What is claimed is:

1. A modular unit configured for attachment to a building frame, the modular unit comprising:

a plenum having walls defining a perimeter of material;

a horizontal rail extending along a top of the plenum and connected to and supporting each of the walls of the plenum, the rail connected to an upper portion of each wall;

a grid of supports attached to the plenum, the supports defining a suspended ceiling; and a truss separate from the grid of supports and directly attached to and supported by the rail, the truss arranged inside the plenum, the truss configured to support ceiling-mounted equipment and transmit the load of the ceiling-mounted equipment to the rail, wherein the plenum is suspended from the building frame.

2. The modular unit of claim 1 wherein the plenum is suspended from the building frame by a plurality of hangers.

3. The modular unit of claim 1 wherein the truss includes an equipment interface plate configured to attach to the ceiling-mounted equipment.

4. The modular unit of claim 1 including an apparatus mount which is attachable to the grid of supports, wherein the ceiling-mounted equipment is configured to be hung from the apparatus mount.

5. The modular unit of claim 1 wherein the truss is attached to the grid of supports.

6. The modular unit of claim 1 wherein an air handling component is positioned within the perimeter.

7. The modular unit of claim 1 further comprising a top attached to a top margin of the perimeter along the entire perimeter, forming a substantially airtight seal therewith.

8. The modular unit of claim 7 wherein the perimeter has at least one side and a hole formed through the at least one side, wherein the hole is configured to permit air to flow into the unit.

9. The modular unit of claim 8 wherein an air handling component is positioned proximate the hole.

10. The modular unit of claim 7 wherein the top has a hole configured to permit air to flow into the unit.

11. The modular unit of claim 1, wherein the truss comprises at least one upper spar connected to at least one lower spar by at least one cross member.

12. The modular unit of claim 11, wherein the truss further comprises at least one diagonal cross member configured to provide resistance to twisting.

13. The modular unit of claim 1, wherein the truss includes at least one dedicated passageway configured for routing of electrical conduits or supplying natural gas, refrigerant, water, or gas.

14. The modular unit of claim 1, wherein the grid of supports is attached to a lower portion of the walls of the plenum.

15. A modular unit configured for attachment to a building frame, the modular unit comprising:

a plenum having a perimeter of material formed into a rectangular box;

a horizontal rail extending along a top of the plenum and connected to and supporting the plenum;

a grid of supports attached to the perimeter of the plenum, the supports defining a suspended ceiling suspended from the perimeter of the plenum;

a truss separate from the grid of supports and directly attached to and supported by the rail, the truss contained inside the rectangular box; and an apparatus mount attached to at least one of the supports, wherein an apparatus is configured to be hung from the apparatus mount, wherein the plenum is suspended from the building frame.

16. The modular unit of claim 15 wherein the grid of supports is attached to a bottom margin of the perimeter.

17. The modular unit of claim 15 wherein the grid of supports comprises extruded aluminum.

18. The modular unit of claim 15 wherein the grid of supports comprises sheet steel formed into a tubular configuration.

19. The modular unit of claim 15 wherein the grid of supports comprises sheet steel formed into an inverted U-channel configuration.

20. The modular unit of claim 15 wherein the apparatus mount includes a support plate configured to rigidly attach to the apparatus.

21. A modular unit configured for attachment to a building frame, the modular unit comprising:

a plenum having walls defining a perimeter of material;

a horizontal rail extending along a top of the plenum and connected to and supporting each of the walls of the plenum, the rail connected to an upper portion of each wall;

a grid of supports attached to the plenum, the supports defining a suspended ceiling;

a truss separate from the grid of supports and directly attached to and supported by the rail, the truss arranged inside the plenum, the truss capable of supporting at least 900 lbs of ceiling-mounted equipment and transmitting the load of the ceiling-mounted equipment to the rail, and wherein the plenum is suspended from the building frame by a plurality of hangers.

* * * * *